US005081805A

United States Patent [19]

Jazzar

[11] Patent Number: 5,081,805

[45] Date of Patent: Jan. 21, 1992

[54] PRECAST CONCRETE BUILDING UNITS AND METHOD OF MANUFACTURE THEREOF

[76] Inventor: M. Omar A. Jazzar, 520 Cleveland St., Clearwater, Fla. 34615

[21] Appl. No.: 558,858

[22] Filed: Jul. 27, 1990

Related U.S. Application Data

[62] Division of Ser. No. 398,095, Aug. 23, 1989, abandoned.

[51] Int. Cl.[5] ..... E04H 1/00

[52] U.S. Cl. ..... 52/79.2; 52/79.9; 52/79.14; 52/236.1; 52/251

[58] Field of Search ..... 52/79.1, 79.2, 79.3, 52/79.4, 79.9, 79.14, 250, 251, 252, 236.3, 236.1, 236.5, 236.6, 134, 136, 137

[56] References Cited

U.S. PATENT DOCUMENTS

| | | | |
|---|---|---|---|
| 2,582,161 | 1/1952 | Randall . | |
| 2,942,321 | 6/1960 | Pinter et al. . | |
| 3,201,907 | 8/1965 | Henderson | 52/79.14 X |
| 3,510,997 | 5/1970 | Ratych | 52/79.2 |
| 3,558,095 | 1/1971 | McNiel . | |
| 3,741,515 | 6/1973 | Rice . | |
| 4,033,545 | 7/1977 | Duwe et al. . | |
| 4,048,772 | 9/1977 | Gaul | 52/236.3 X |
| 4,142,705 | 3/1979 | Miller . | |
| 4,159,602 | 7/1979 | Polack | 52/79.9 |
| 4,178,343 | 12/1979 | Rojo, Jr. . | |
| 4,180,233 | 12/1979 | Johnson . | |
| 4,214,413 | 7/1980 | Los Monteros | 52/236.1 |
| 4,606,878 | 8/1986 | Day et al. . | |
| 4,673,159 | 6/1987 | Schmidgall . | |

FOREIGN PATENT DOCUMENTS

| | | | |
|---|---|---|---|
| 26307 | 7/1920 | Denmark . | |
| 3505465 | 8/1986 | Fed. Rep. of Germany . | |
| 50745 | 10/1966 | German Democratic Rep. | 52/79.2 |
| 626189 | 9/1978 | U.S.S.R. | 52/79.14 |
| 1237434 | 6/1986 | U.S.S.R. . | |
| 1274929 | 12/1986 | U.S.S.R. . | |

*Primary Examiner*—Richard E. Chilcot, Jr.
*Attorney, Agent, or Firm*—Warren L. Franz

[57] ABSTRACT

A precast concrete building unit of half-room configuration with a floor or ceiling defining web portion and opposite half-wall defining flange portions is cast by pouring concrete over steel latticework in an inverted U-shaped cavity of a wheeled mold form which has hinged sidewall plates, removable pin mounted or hinged end plates, and a width variable segmented top plate. Matching ridge and depression insert elements placed in the mold serve to form the bases of the flanges with mating tongue and groove shear keys when the units are brought into flange-to-flange upright/inverted unit pairs to form whole rooms. Staggered blocks mounted on the top edges of the top plates project into the mold to form interlocking bearing surfaces for mating diagonally positioned web-to-web upright/inverted unit pairs. Units formed in the same mold can be used for rooms, columns, shear walls, retaining walls, elevator shafts, stairwells, girders and pedestrian bridges.

8 Claims, 4 Drawing Sheets

FIG. 1
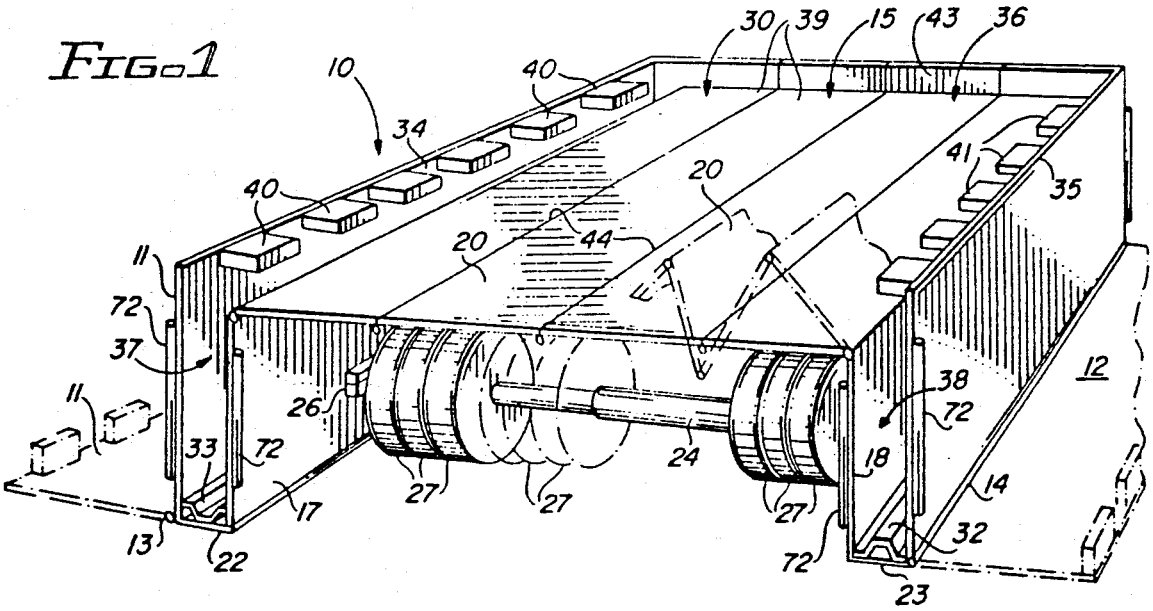
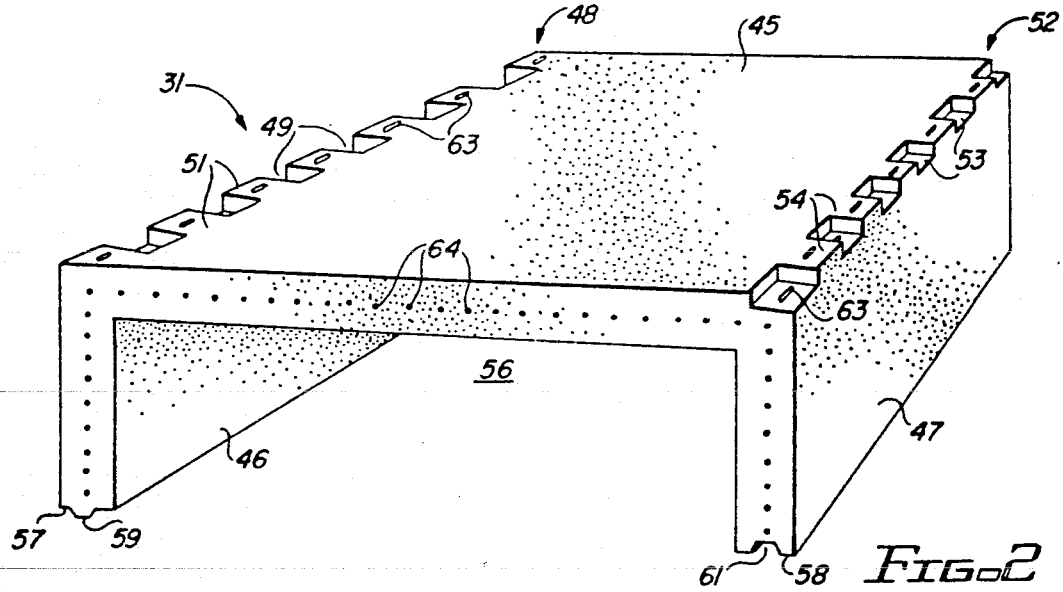
FIG. 2
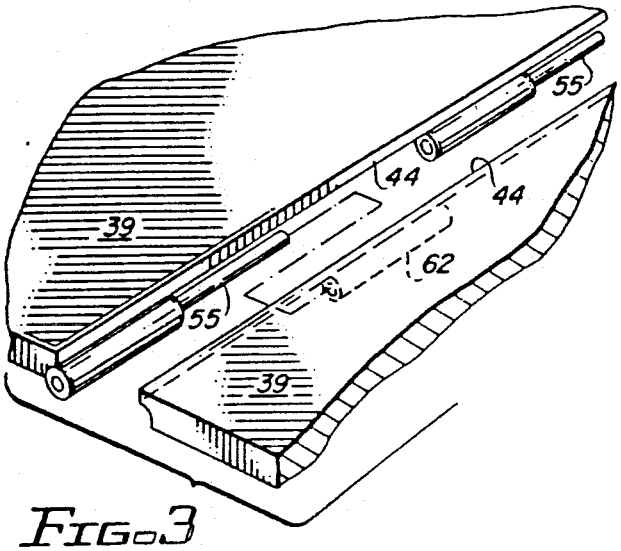
FIG. 3
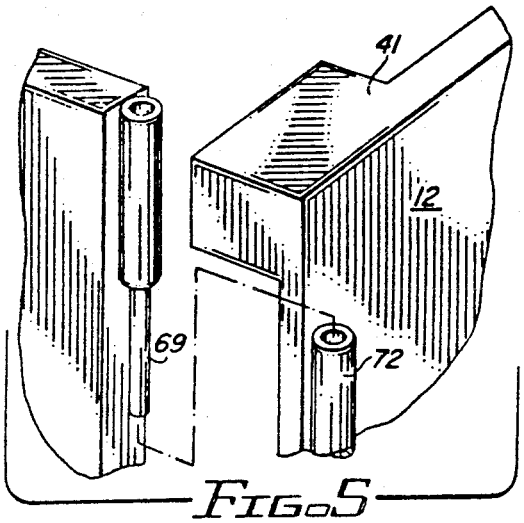
FIG. 5

FIG. 7
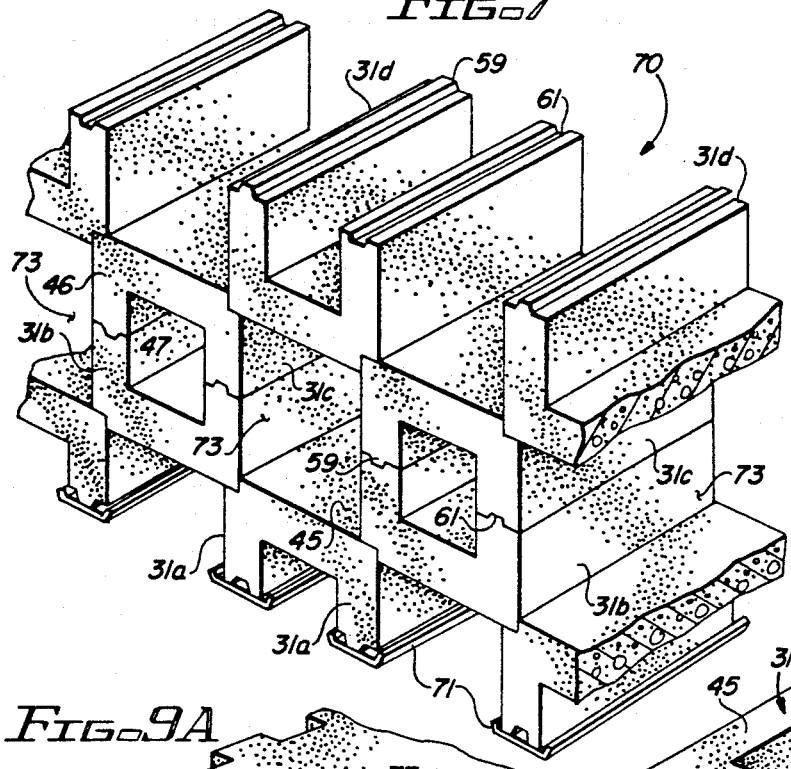
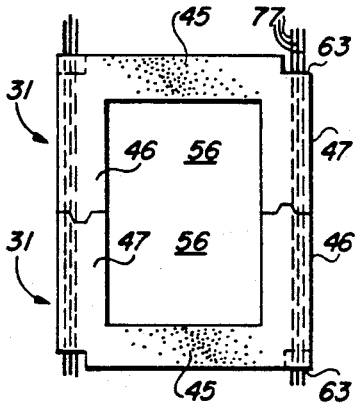
FIG. 9B
FIG. 9A
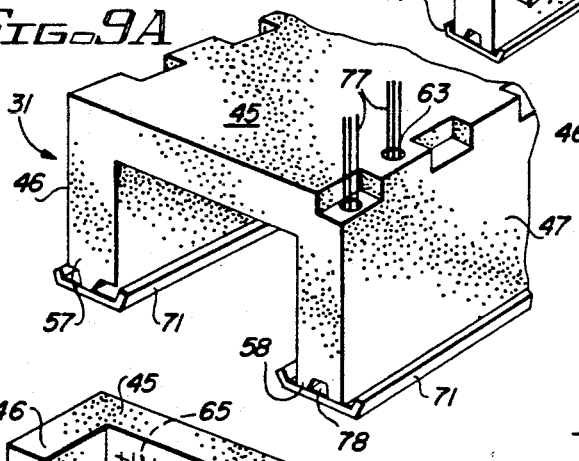
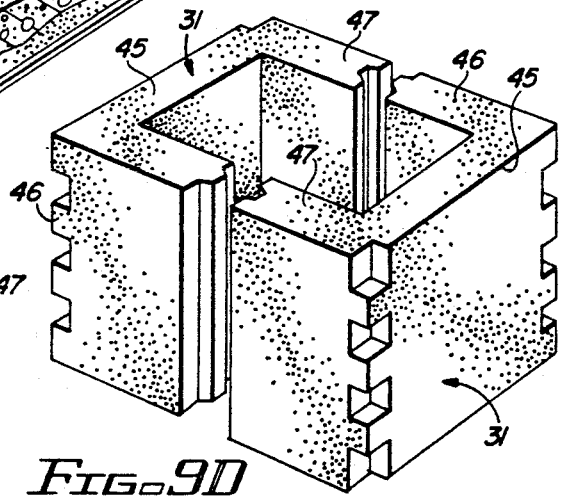
FIG. 9D
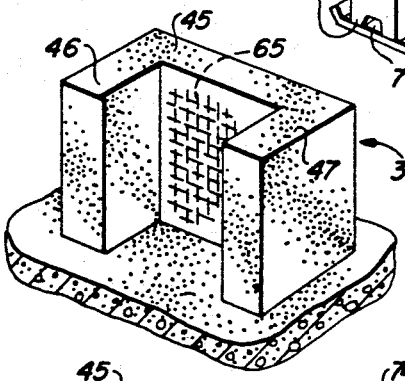
FIG. 9E
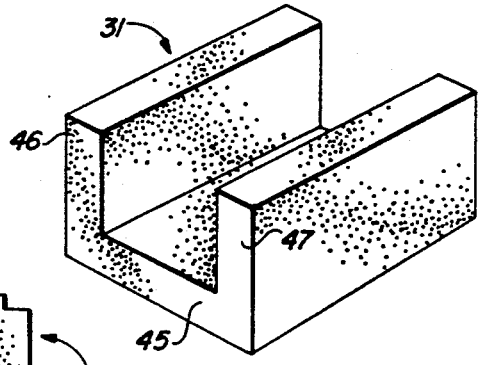
FIG. 9F
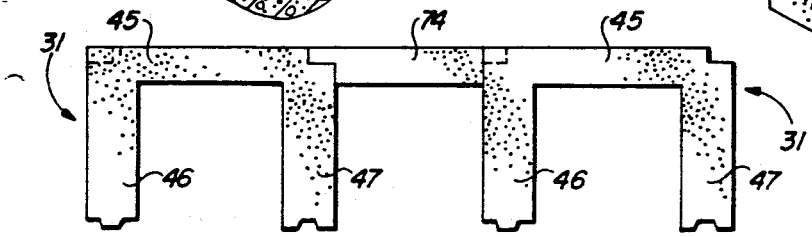
FIG. 9C

PRECAST CONCRETE BUILDING UNITS AND METHOD OF MANUFACTURE THEREOF

This is a division of copending U.S. patent application Ser. No. 07/398,095, filed Aug. 23, 1989, abandoned.

BACKGROUND OF THE INVENTION

This invention relates generally to improved concrete building units and further to a method and apparatus for precasting the same.

Precast concrete building units of various types are known for use in building construction. A principal advantage of such elements is a reduction in labor costs and time incurred in erecting a building structure. It is known to precast entire room units, entire wall units and various other building elements, in a wide variety of sizes and configurations. Each of these units has its own benefits and advantages, as well as its own disadvantages and drawbacks. Many require heavy capital outlay for costly manufacturing plant facilities, costs to bring the precast units from point of manufacture to the building site, additional reinforcing for extensive transportation and handling, and special on-site erecting equipment.

It is known, for example, in hotel/motel building construction to assemble an entire building in modular form piecing together complete room units having prefabricated integral walls, ceiling and floor. Such units are large and heavy, which requires costly forming and causes difficulties in manufacture, transportation and erection. The room size is fixed in accordance with the precast unit, so variation in room size requires variation in the size of the molded unit. The height of the unit necessitates the use of scaffolding or similar structure in casting the ceiling and special accommodation must be made in the forms to achieve the box-like, hollow structure. Also, when such units are placed side by side to create the building structure, the wall thickness between adjacent rooms is unnecessarily doubled.

The unitary box-like structures such as those described suffer from a lack of flexibility and versatility and are limited in the uses to which they may be put. In a hotel/motel or condominium construction, for example, utilizing precast complete room units, an entire building will require additional on-site pouring or precast units of other types in order to complete assembly, the modular room units being suitable only for use as the rooms.

U.S. Pat. No. 4,606,878 to Day et al., for example, shows a method and apparatus for constructing complete precast concrete modular building units which include a base slab, a roof, two sidewalls and one end wall formed in a single molding operation. The outer surfaces are fabricated using a collapsible outer form having sidewall and end wall plates pivotally connected to a rectangular base plate. The interior surfaces are formed using a retractable inner form having hydraulically positionable elements. The mold form is very costly and the resulting structure is large and heavy, and limited in the uses to which it can be put. Also, the internal mechanism requires a certain minimum degree of skill to ensure proper operation.

U.S. Pat. No. 4,178,343 to Rojo, Jr. discloses a method and apparatus for precasting building components in the form of vertical wall units by means of reusable separable mold forms that are wheelable and can be utilized on-site. The units of Rojo, Jr. are smaller and more versatile than the larger, complete units of Day et al. but, nevertheless, require considerable on-site labor and erection skill and the use of a multiplicity of other components during building assembly. And, because of their small size, the number of units needed is very high.

SUMMARY OF THE INVENTION

It is an object of the present invention to provide an improved precast concrete building unit in the form of a partial room configuration, which is suitable for use in room construction, but which also offers great versatility and flexibility for use as other components in modular building construction.

It is another object of the invention to provide a method and apparatus for manufacturing an improved precast concrete building unit using unskilled labor, on-site, employing simple steps that can be accomplished at ground level, under any weather conditions, with a high degree of repeatability, and with simple, manageable, inexpensive forms.

In accordance with one aspect of the invention, a freestanding precast concrete building unit is provided in the form of a half-room having an inverted U-shaped configuration with a generally planar, horizontally extending top section or web, from opposite longitudinal edges of which depend a pair of spaced, generally planar, vertically extending flanges or leg sections. The bases of the flanges or legs are respectively provided with complementary male and female members which provide interlocking shear keys when two identical such units are assembled in leg-to-leg, inverted relationship to complete top and bottom halves of a room. The outside top edges of each unit are formed with complementary alternating tabs and voids to provide interlocking of the adjoining edges of identical units placed in diagonally adjacent, top-to-top inverted relationship.

A method for simple on-site fabrication of such a precast concrete building unit is provided by reusable molding apparatus in the form of a wheeled cart of uniform inverted U-shaped cross-section having a pair of laterally spaced, vertical outer sidewall plates hingedly attached at lower edges to outside edges of outwardly extending flanges of a mold bottom comprising a pair of laterally spaced, lesser height, vertical inner sidewall plates joined at upper edges by a horizontal top plate. The outer sidewall plates are movable from normal vertical, mold "closed" positions to horizontal, mold "open" positions.

In a preferred embodiment of the method and apparatus of the invention, described in detail below, the concrete unit is formed to have a uniform, inverted U-shaped cross-section and integral complementary tongue and groove elements running longitudinally along the respective bases of the legs. The top surface of the unit is formed to provide an alternating, jig-saw like pattern of blocks and voids along opposing upper edges. Steel reinforcing bar latticework is integrated into the unit prior to the concrete pouring step.

The precast concrete building units formed in accordance with the method and apparatus of the invention provide significant benefits over conventional precast structures. With the molding apparatus of the invention, all concrete pouring can be done close to ground level (less than 5 feet high), thereby increasing safety because workers do not have to work on elevated platforms. All unit fabrication can be done at the site of building construction with attendant savings in transportation and storage costs. The simple construction of the wheeled cart molding unit permits ready operation by unskilled labor with a minimum amount of training, under all weather conditions using inexpensive temporary shelters, while achieving a high repeatability in fabrication of identical units. The molding unit is preferably made horizontally extendible by using a multi-sectioned horizontal top plate to give different web sizes. The half-room characteristic of the building unit permits a great degree of flexibility and versatility, allowing a single-style unit to be used in many different ways to serve the function of many different building components, as well as providing different sized rooms in accordance with the readily varied web size selections. The same unit can be used not only for room construction, but also in construction of columns, shear walls, retaining walls, elevator shafts, stairwells, grade beams, girders, pedestrian bridges, etc. This keeps the number of required on-hand molded units to a minimum and there is no inventory or storage requirement to maintain different sizes and configurations for different components of a building. There is little factory overhead for storage of molds and units when not being used. In contrast to complete room units, the half-room units in accordance with the invention are light and readily liftable into interlocking relationships.

BRIEF DESCRIPTION OF THE DRAWINGS

Embodiments of the invention have been chosen for purposes of illustration and description, and are shown in the accompanying drawings, wherein:

FIG. 1 is a perspective view of molding apparatus in accordance with the invention for manufacture of precast concrete building units in accordance with the invention;

FIG. 2 is a perspective view of a precast concrete building unit formed utilizing the apparatus of FIG. 1;

FIG. 3 is a fragmentary enlarged view showing the interconnection of the top plate sections;

FIG. 5 is a fragmentary enlarged view showing the connection of the end wall;

FIG. 7 is a schematic view of a building structure formed using a plurality of the units of FIG. 2;

FIGS. 9A–9F are views helpful in understanding the various uses to which the units of FIG. 2 can be put;

Throughout the drawings, like elements are referred to by like numerals.

DETAILED DESCRIPTION OF PREFERRED EMBODIMENTS

Figure 4:
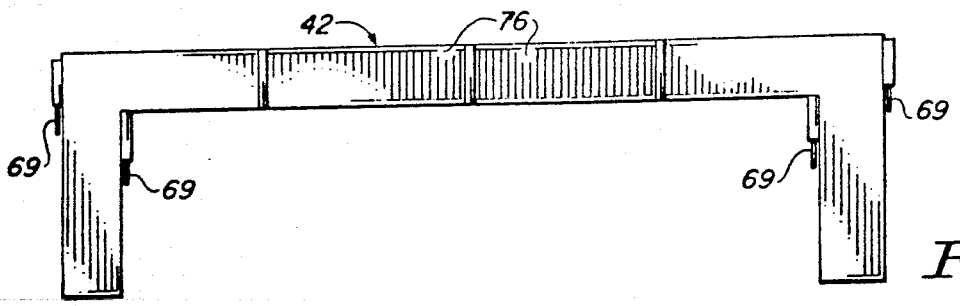
FIG. 4 is a front elevation view of the front end wall plate.

FIG. 1 shows an exemplary implementation of molding apparatus in accordance with the invention for precasting a preferred embodiment of concrete building unit depicted in FIG. 2. The molding apparatus 10 comprises a pair of vertical outer sidewall plates 11, 12 of rectangular configuration connected at their lower longitudinal edges by hinges 13, 14 along respective longitudinal outer edges of a mold bottom 15. The hinges 13, 14 serve to connect the plates 11, 12 for pivotal movement from vertical, mold "closed" positions (shown in solid lines in FIG. 1) to horizontal, mold "open" positions (shown in dot-dash lines in FIG. 1). The mold bottom 15 comprises a generally inverted U-shape cross-sectioned member having rectangular vertical inner sidewall plates 17, 18 joined together along upper longitudinal edges thereof by a rectangular horizontal top plate element 20 and joined respectively to the lower longitudinal edges of the plates 11, 12 by oppositely-directed outwardly extending, horizontal rectangular flange plates 22, 23. A plurality of wheels 27, accommodated on a plurality of axles 24 journalled (as at 26) at longitudinally spaced positions along facing surfaces of the plates 17, 18, support the mold bottom 15 in elevated transportable position above the ground.

The bottom of a mold cavity 30 formed between facing surfaces of the plates 11, 17 and the plates 12, 18 is preferably provided with means for forming complementary male and female parts of a mechanism for interlocking identical precast building units 31 (FIG. 2) manufactured using the molding apparatus 10 of FIG. 1. A preferred such means for forming complementary tongue and groove parts is provided by the depicted insert element 32 having a longitudinal ridge and the insert element 33 having a longitudinal groove or depression, each running centrally for the full lengths of the respective flanges 22 and 23. The ridge element 32 protrudes upwardly into a subportion 38 of the mold cavity 30 defined by the facing inner mold surfaces of the plates 12, 18; the depression element 33 projects downwardly to enlarge the bottom of a subportion 37 of the mold cavity 30 defined by the inner mold surfaces of the plates 11, 17. The inside height (vertical dimension within the cavity 30) of the plates 17, 18 is less than the inside height of the plates 11, 12, so that the elevation of the upper surface of the top plate 20 is below the elevation of the upper longitudinal edges 34, 35 of the plates 11, 12. This elevational difference defines a generally horizontal subportion 36 of the cavity 30 extending between the parallel, generally vertical, spaced subportions 37, 38.

A plurality of blocks 40 are located in longitudinally spaced arrangement along a marginal border of the inner surface of the plate 11 adjacent the upper edge 34. A similar arrangement of a plurality of blocks 41 is located along a corresponding marginal border of the inner surface of the plate 12 adjacent the upper edge 35. The blocks 40, 41 are preferably of identical size, with the blocks 40 being located to face the spaces between the blocks 41, and vice versa. This staggering of the block arrangements is for the purpose of establishing complementary alternating tabs and voids in the molded building unit 31 (FIG. 2), as discussed further below. The blocks 40, 41 are shown as identical rectangular cubic structures having length dimensions along the edges 34, 35 chosen to provide the desired interlocking and bearing surfaces for edge-to-edge interconnection of units 31, and height dimensions (vertical dimension in solid line positions shown in FIG. 1) of approximately one-half the difference in vertical elevation separating the top plate element 20 and the upper edges 34, 35 of the plates 11, 12. The width dimensions (horizontal left to right lateral dimension in the solid line positions of FIG. 1) are approximately one-half the width dimension of the cavity subportions 37, 38. The block numbers, arrangement and dimensions can be varied to suit and desired interlocking tab and void configuration for the molded units 31 (FIG. 2), without sacrificing the structural integrity of the units.

The top plate 20 is preferably formed by joining a plurality of elongated sections 39 in hinged relationship along adjacent longitudinally extending edges 44. This can be done by inserting longitudinally aligned pins 55 of one section 39 into longitudinally aligned pin receiving channel forming tubular elements 62 on an adjacent section 39, as indicated in FIG. 3. The pins 55 and elements 62 are arranged on the underside of the sections 39, so that they do not protrude into the cavity 30. This segmented arrangement of the top plate 20 permits sections 39 to be added or removed as desired to change the lateral dimension of the mold 10. The arrangement also permits the plates 11, 12 to be moved toward each other for transportation or storage of the empty mold, by folding the sections 39 as indicated into the folded dot-dash line positions shown in FIG. 1. To permit such folding, accommodation is made, such as making the axle 24 telescopic as shown, to allow the wheels 27 to move laterally toward each other into the depicted dot-dash line positions. Bracing (not shown) can be added, as appropriate, to keep the mold top from folding when in use.

The front and back open ends of the molding apparatus 10 can be selectively closed by any suitable means such as, for example, inverted U-shaped vertical end wall plates 42 (FIG. 4), 43 (FIG. 1) which can be attached to the rest of the mold 10 by means of vertically aligned pins 69 on the plates 42, 43 that fit into vertically aligned channel forming elements 72 on the main mold 10, similar to the way the pins 55 engage the elements 62. Alternatively, the plates 42, 43 can be hinged at their lower edges along the bottom lateral edges of the flanges 22, 23. This permits the plates 42, 43 to be brought, as with the plates 11, 12, between vertical, mold "closed" positions (shown by the solid line position of plate 43 in FIGS. 1 and 6B) and horizontal, mold "open" positions.

The plate 42 (FIG. 4) is substantially identical in configuration and operation to the plate 43; however, depiction of the plate 42 in its normal vertical position has been omitted in FIG. 1 for clarity in order to be able to view the details of the mold cavity 30 and other internal components of the molding apparatus 10. The plate 42 has the same generally inverted U-shaped configuration as, though slightly larger than, the cross-section of the cavity 30. The laterally extending top portions of the plates 42, 43 can be formed in segmented fashion by coupling sections 76 in hinged relationship, as for the hinged section arrangement of the top plate 20. It will be appreciated that, except for the differences in the complementary elements 32, 33 and the alternating arrangement of the blocks 40, 41, the molding apparatus 10 depicted in FIG. 1 is substantially symmetrical about both longitudinal and lateral center lines.

FIG. 2 shows a preferred embodiment of freestanding precast concrete building unit 31 in accordance with the invention, manufactured utilizing the wheeled molding apparatus 10 of FIG. 1. The molded unit 31 generally takes a shape identical to that of the mold cavity 30 of the apparatus 10 which is the complement of the contour of the inner mold surfaces of the plates which define the mold cavity.

The unit 31 comprises a generally planar, horizontally extending top section or web 45 from opposite longitudinal edges of which depend a pair of spaced, generally planar, vertically extending leg sections or flanges 46, 47. The upper surface of the top section 45 is generally flat and corresponds to a plane defined between the upper edges 34, 35 of the plates 11, 12, and similar edges of the plates 42 and 43, when those plates are positioned in their vertical, mold "closed" positions. The outer, non-facing surfaces of the leg sections 46, 47 are also generally flat and correspond to the planes of the facing, inner mold surfaces of the outer vertical sidewall plates 11, 12 of the mold 10. The lines of juncture between the upper surface of the section 45 and the outer non-facing surfaces of the legs 46, 47 are characterized by alternating tabs and voids representing the complementary imprint of the blocks 40, 41 which protrude into the mold cavity 30 of the apparatus 10 adjacent the top edges 34, 35 of the plates 11, 12 during the molding process. The left juncture line 48 (FIG. 2) has alternating voids 49 and tabs 51 corresponding in positions to the positions of the blocks 40 and spaces between the blocks 40, respectively, of the mold 10; and the right juncture line 52 has alternating voids 53 and tabs 54 corresponding in positions to the blocks 41 and spaces between the blocks 41, respectively. The tabs 51 are dimensioned and configured to complement and fit into the voids 53; and the tabs 54 are likewise dimensioned and configured to complement and fit into the voids 49.

The under or lower surface of the section 45, located between the facing surfaces of the legs 46, 47, is also generally flat and corresponds to the upper surface of the plate 20 (FIG. 1) of the mold bottom 15. The facing surfaces of the legs 46, 47, similarly correspond to the flat planar, non-facing inner mold surfaces of the inner sidewall plates 17, 18. The space left between the facing surfaces of the legs 46, 47 and which is bounded at its top by the lower surface of the top section 45 defines an open-bottomed half-room chamber area 56, discussed further below.

The bases 57, 58 of the respective leg sections 46, 47, are generally planar rectangular horizontal surfaces, except for a tongue 59 that extends centrally and longitudinally for the full length of the base 57 and a groove 61 that extends centrally and longitudinally for the full length of the base 58. The bottom surface of the base 57 corresponds to the complementary impression of the top surface of the insert 33 placed above the flange 22 during molding (see FIG. 1); and the bottom surface of the base 58 corresponds to the complementary impression of the top surface of the insert 32 placed above the flange 23. The top surfaces of the inserts 32, 33 and thus the tongue 59 and groove 61 are formed as complementary male and female members whose purpose is to act as two-way shear keys to assist in interlocking a pair of adjacent units 31, brought into leg-to-leg relationship, as further described below. If preferred, the shapes of the inserts 32, 33 can be incorporated directly into the flanges 22, 23 themselves.

The dimensioning of the units 31 is selected to provide the desired material strength and configuration needed for the building construction intended. The leg or flange sections 46 and 47 are generally made identical except for variation necessitated by the accommodation of the tongue 59 and groove 61. For the unit 31 shown in FIG. 2 formed by the molding apparatus 10 of FIG. 1, the vertical dimension of the voids 49, 53 is suitably chosen to be about one-half the vertical dimension or thickness of the top section 45, and the lateral horizontal dimension (laterally of the top section 45) of the voids 49, 53 is chosen to be approximately one-half the corresponding horizontal dimension or thickness of the legs 46, 47. A typical steel reinforced unit 31 molded using the apparatus 10 may have a longitudinal dimension (front to back) approximately 6 meters; a lateral dimension (side to side) of approximately 3.7 meters; a height dimension (top to bottom) of approximately 1.4 meters; and a leg thickness of approximately 0.2 meters.

Latticework in the form of intermeshed steel reinforcing rods or bars 64 is preferably integrated within the structure of the unit 31 to provide a reinforced composite concrete unit. Hollow channels of cores 63 can be optionally formed to run vertically through the legs 46, 47, if desired, to serve as conduits through which additional reinforcing bars may be run to extend through a plurality of interconnected units 31 during assembly of the building structure. The hollow cores 63 may, for example, be used to run further reinforcing bars 77 (see FIG. 9A) through units 31 which are stacked with cores 63 aligned to extend through multiple stories of the same building (see FIG. 7). Grout or other similar binding substance can then be poured under pressure to fill the cores 63, thereby providing reinforced columns rigidly joining the units. Hollow channels or cores can also be run to use the same technique horizontally, if desired, to connect webs of adjacent units together or to connect units to slabs, as needed.

Figure 6A:
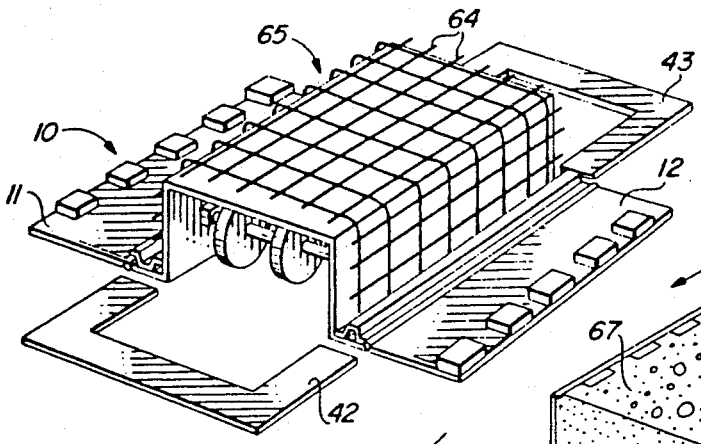
FIGS. 6A–6C are schematic views helpful in understanding the method of manufacturing the building unit of FIG. 2 using the molding apparatus of FIG. 1.
Figure 6B:
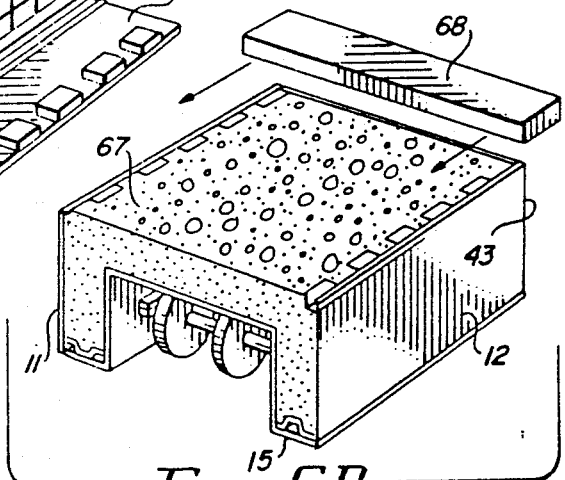
Figure 6C:
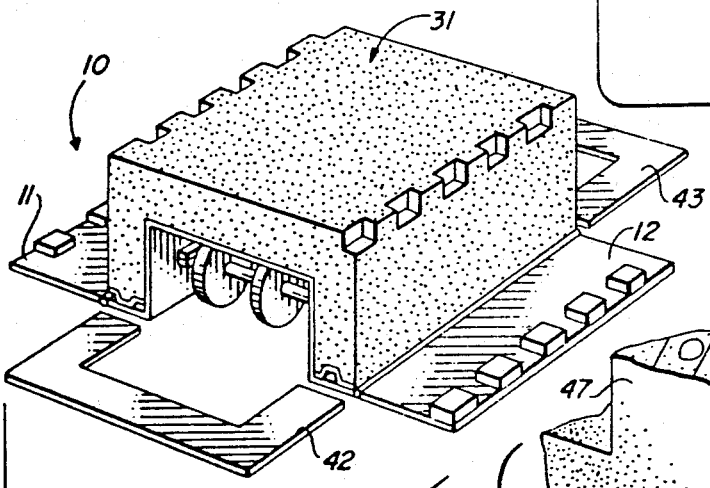

The method of manufacture of the unit 31 utilizing the molding apparatus 10 is illustrated with reference to FIGS. 6A–6C. As shown in FIG. 6A, the empty mold 10 is opened by pivoting the sidewall plates 11, 12 into their respective horizontal, mold "open" positions and by removing or pivoting the end wall plates 42, 43 to give access to the interior of the mold cavity 30. A latticework 65 of steel reinforcing bars 64 is then positioned as desired around the top and sides of the mold bottom 15. The side plates and end plates 11, 12, 42 and 43 are then brought into their normal vertical, mold "closed" positions, as shown in FIG. 6B (plate 42 has been omitted for clarity). A conventional formulation of mixed concrete 67 is then poured into the mold cavity 30 defined between facing and adjacent inner mold surfaces of the plates and the mold bottom 15. Vibrators or similar means are applied to remove air bubbles from the concrete mix and the top surface of the uncured unit 10 is leveled by means of a beam or other scraping device 68 which is drawn along the top edges 34, 35 (FIG. 1) of the plates 11, 12, such as in the direction indicated by the arrows in FIG. 6B. Studs or other channel creating elements (viz. styrofoam or cardboard tubing) to make the hollow channels or cores 63 (FIG. 2) or other features, and conventional lifting rings or hooks (not shown) for later use in hoisting the finished unit, may be added prior to or during the concrete pouring step. When the concrete 67 has cured sufficiently, the mold 10 is opened by pivoting the side plates 11, 12 into their horizontal, mold "open" positions and removing the end plates 42, 43. The molded unit 31 can then be removed. The hinged, segmented nature of the top plate element 20 can be used to assist in that regard. The resulting unit 31 will generally bear the shape of the mold cavity 30. The units 31, thus formed, can now be oriented and stacked as needed to construct the modular building.

Figure 8:
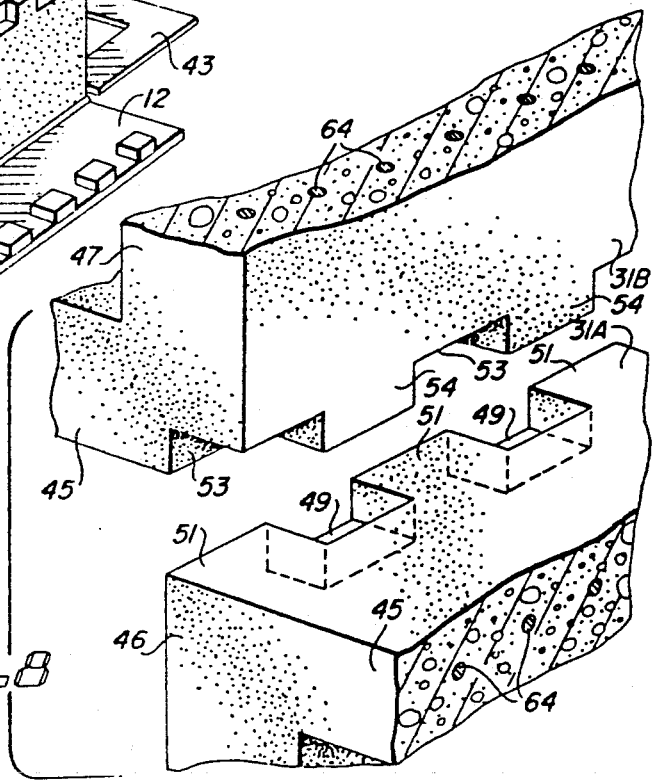
FIG. 8 is a fragmentary enlarged view showing the top edge interlocking scheme for adjacent building units.

An exemplary stacking arrangement for a plurality of precast units 31 is shown in FIG. 7. A first row of units 31*a* is placed spaced, in parallel alignment with the unit legs or flanges 46, 47 pointed downward in normal unit position to form the foundation of a building 70 shown. Each leg 46, 47 is brought to bear on an upward facing surface of a concrete U-shaped footing member 71. Grout or a similar binding substance 78 is used to fill the gaps and bond the bases 57, 58 to the members 71 (see FIG. 9A). A next row of inverted units 31*b* is then applied overlying the spaces between the units 31*a* to straddle the units 31*a*, with the tops or webs 45 of units 31*b* facing down and their legs or flanges 46, 47 pointing up. The units 31*b* are brought into interlocking relationships with the underlying units 31*a*, the tabs 54 of the lines 52 (see FIG. 2) of the units 31*b* fitting into the complementary voids 49 of the lines 48 of the units 31*a*, and the tabs 51 of the lines 48 of the units 31*b* fitting into the complementary voids 53 of the lines 52 of the units 31*a*. This jigsaw puzzle-like interconnection at the upper leg edges of diagonally placed units 31 of different stories is apparent from the exploded view of FIG. 8.

A third row of upright units 31*c* is then brought into direct leg-to-leg section alignment above the inverted units 31*b*, with the tongues 59 of the units 31*c* fitted within the grooves 61 of the units 31*b*, and vice versa. A fourth row of inverted units 31*d* is then fitted in diagonally placed, edge-to-edge block interlocking relationship over the spaces between adjacent units 31*c*; and so forth, for the entire structure of the building.

Such an arrangement of units 31 is suitable, for example, for modular construction of a hotel/motel, condominium or similar multilevel housing structure 70, with the open bottomed chamber areas 56 (see FIGS. 2 and 9B) of upright and inverted block couples 31*b*, 31*c* serving to define the interior volume of a standard room. In such case, the dimensioning of the legs 46, 47 is chosen so that the inside height or vertical dimension corresponds to one-half the inside height of the desired room and the longitudinal horizontal dimension corresponds to the length of the room. Each unit 31 in such a pairing arrangement has a top section or web 45 serving as either a ceiling or a floor of the room, and two leg sections or flanges 46, 47 serving as either the upper or lower halves of opposite sidewalls. The volumes 73 (FIG. 7) located between pairs of units 31*b*, 31*c* of the same story define the interior volumes of alternating rooms on the same floor and may be the same as or different than the interior volume formed by the areas 56.

In contrast to known modular multilevel housing prefabricated unit constructions using complete room units of full height, adjacent rooms of the same story utilizing the units 31 are formed without the necessity of providing double thickness walls. The use of half-room units 31 both facilitates manufacture and makes building assembly easier. Because of the open-bottomed nature of the half-room sized chamber area 56 (FIG. 2), molding of both ceiling and floor in the same unit is not required permitting attendant simplified design of the molding apparatus 10. The reduced height permits access to the top of the apparatus 10 for operation of a scraper or similar implement 68 (see FIG. 6B) at low elevation, with greater safety than where access to a top of a full height unit is required. The lower weight of the half room unit requires lower crane lifting requirements.

The half height unit offers greater flexibility and versatility than conventional complete room units, as illustrated by the configurations set forth in FIGS. 9A–F. The precast reinforced concrete unit 31 of the present invention provides in a single unit an element that not only can serve in a pair as a modular room structure, but can also serve the role of a foundation grade beam, a girder, a retaining wall, and a shear wall, depending on its placement. The reinforcing steel latticework 65 (FIG. 6A) can be arranged to suit the stresses that will be experienced by the unit for the particular usage.

FIG. 9A shows a unit 31 in its normal, legs-down upright orientation used as a grade beam with each leg or flange 46, 47 supported on a footing member or foundation block 71. The blocks 71 are poured to have depressions running centrally along their lengths. Steel strands 77 are added to project vertically up from the blocks 71 and through the hollow cores 63, with the gaps between the bases 57, 58 and the depression of the blocks 71, as well as the cores 63, being filled up with grout 78.

FIG. 9B shows a pair of the same units 31 superposed in leg-to-leg contact positions, the lower unit 31 being inverted to form the floor and lower halves of opposite walls of a room and the upper unit 31 being in its upright position to form the ceiling and top halves of the same walls. Such paired units can be stacked as already described in connection with FIG. 7, above. Every two or three stories, steel strands 77 can be threaded through the hollow cores 63 down to the footings 71, with the cores then filled under pressure with grouting to transform the cores 63 into continuous reinforced columns which extend the full height of the building. The whole building will thus be tied and integrated together. The reinforcing bar 64 in the latticework 65 can be the same for units 31 used at upper and lower elevations, with allowance for heavier load bearing capability in lower units being made by fitting the cores 63 of the lower units with more and larger member 77 than used in upper units.

FIG. 9C shows a pair of upright units 31 positioned in parallel aligned, laterally spaced relationship and carrying legless plank units 74 between upper edges of facing legs 46, 47 of the different units, thereby functioning in the manner of a girder. It is noted that, by taking out the middle sections 39 of the top plate 20 of the mold 10 (FIG. 1), the lateral width (sidewall plate 11 to sidewall plate 12) of the mold can be reduced. An article 31 can thus be molded from the same mold 10 which is narrow yet deeply flanged, and lends itself well to long span girder construction.

FIG. 9D units 31 rotated 90° about a horizontal axis parallel to a lateral edge, to stand the units 31 on end for the purpose of serving as columns or shear walls. A pair of such rotated units 31 brought into spaced leg-to-leg relationship can conveniently function as the shell structure of a stairwell or elevator shaft. FIG. 9E shows the same shear wall unit without voids 49, 53 along lines 48, 52 (see FIG. 2) and without the tongue 59 and groove 61. Such modifications can readily be made merely by removing the blocks 40, 41 and the inserts 32, 33 from the mold 10 (FIG. 1). Extra reinforcing steel mesh is used in the latticework 65 at the web 45 when unit 31 is used as a shear wall. FIG. 9F shows a narrow unit 31, without voids 49, 53 and without elements 59, 61, used in an upright position as a pedestrian bridge.

Figure 10:
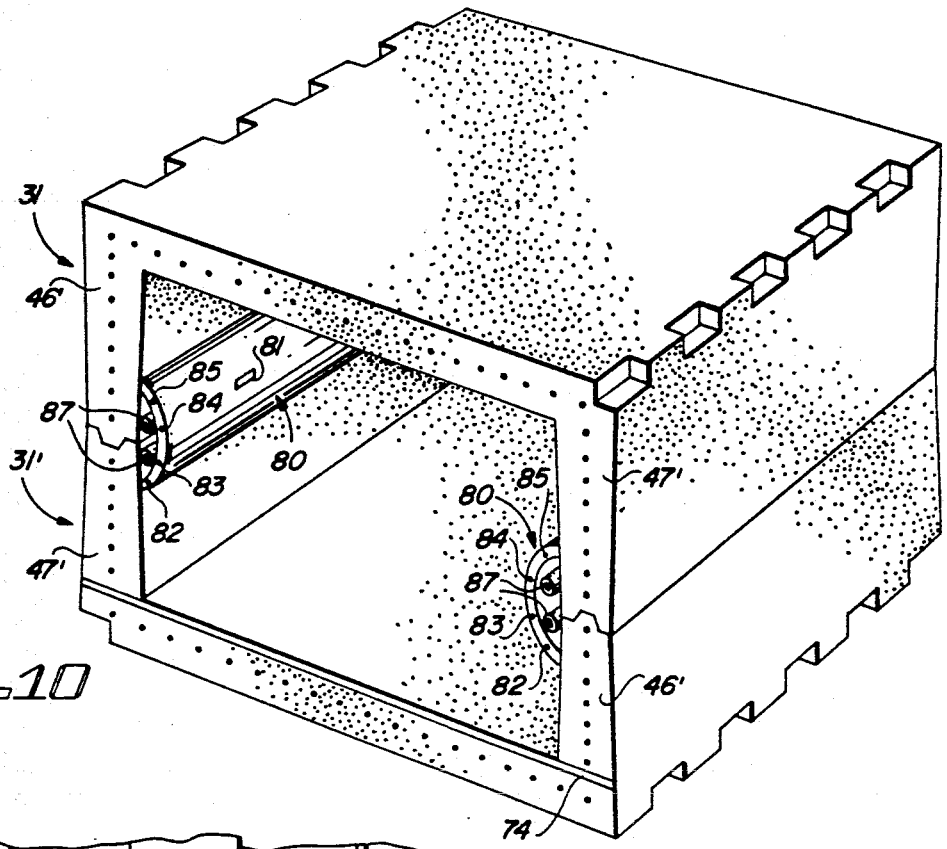
FIG. 10 is a view of a modified form of the unit of FIG. 2, shown utilized in a configuration similar to that of FIG. 9B.

A modified form of building element 31 is shown by the units 31' illustrated in FIG. 10. The units 31' are similar to the units 31 already discussed; however, the leg sections 46', 47' are uniformly outwardly tapered from their bases to their juncture lines and the top sections 45 are provided with a horizontally extending ledge cutout or groove 74 at one end surface adjacent the lower surface formed by contact with the top surface of the top plate element 20 of the molding apparatus (see FIG. 1). The tapering provides a preformed indentation at the construction joint running centrally, longitudinally along the lengths of the opposite walls of a room formed by bringing a pair of upright and inverted units 31' into leg-to-leg association, as for the pair of units 31 shown in FIG. 9B.

The indentation can be conveniently covered with an elongated linear diffusing unit 80 of arcuate shape shown with its concave surface facing the indentation and affixed to the mated leg pair 46', 47' by means of removable fasteners 81. The strips 80 are preferably formed of hollow construction and contain a plurality of conduits 82, 83, 84 and 85 running longitudinally therein to provide heating, cooling, telephone, cable television, etc. to the room thus configured. The area left between the wall indentation and the concave surface of the strip 80 serves to accommodate fluorescent lighting fixtures 87, whose light can be either emitted through translucent portions of the strip 80 or emitted in diffused, indirect lighting manner out from behind the strip 80 at spaces between the strip and the legs 46', 47' along longitudinal edges 88, 89 of the strip.

Figure 11:
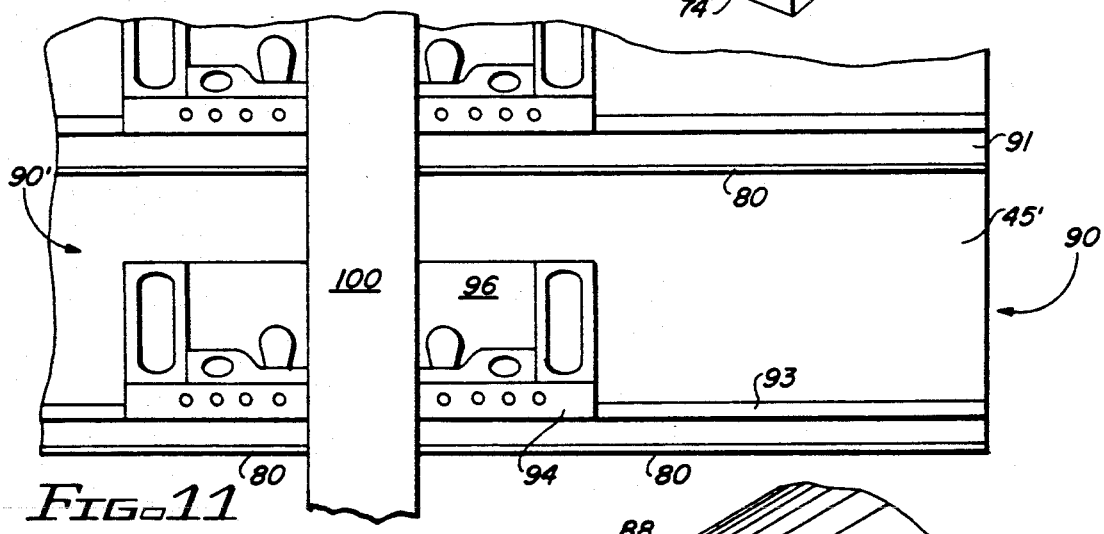
FIG. 11 is a schematic room plan of hotel/motel rooms constructed utilizing the modular configuration of FIG. 10.
Figure 12:
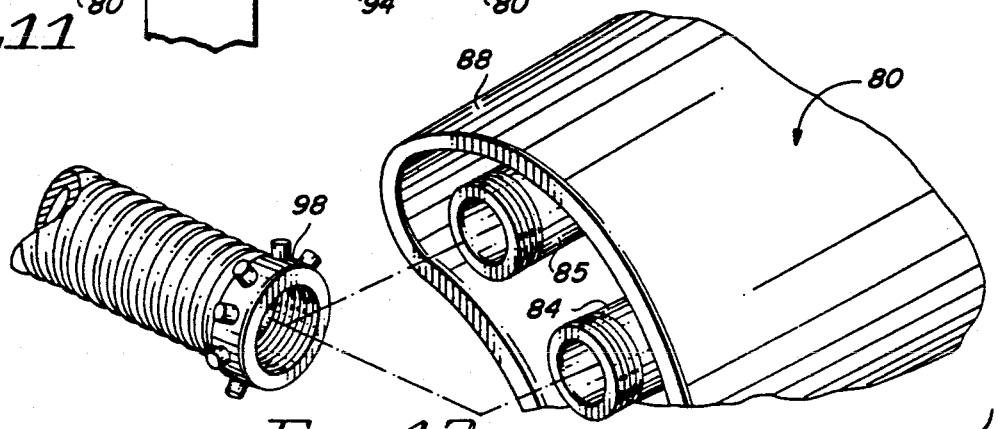
FIG. 12 is an enlarged fragmentary view showing the connection of main utility lines to integral conduits incorporated into the modular unit of FIG. 10 for use in the room plan of FIG. 11.

A top plan schematic layout of a hotel/motel structure formed by such adjacent leg-to-leg pairs of units 31' is shown in FIG. 11. Each room 90 formed between adjacent leg pair columns 91, 92 has a linear diffuser strip 80 running along one wall and another similar though shorter strip 93 running along an opposite wall. Connections of the conduits 82–85 of the strips 80, 93 to building hot and cold water lines, television and telephone calling etc. can conveniently be made in a walled-off utilities access area 94 located, for instance, in a bathroom partitioning 96, utilizing flexible hose couplings 98 (FIG. 12) or similar mechanisms.

Corridors can be formed between facing rooms by placement of planar, rectangular concrete reinforced slabs 100 between the facing rooms 90 by supporting the same through placement on the ledges 74 (FIG. 7) formed on the units 31'.

The building unit formed in accordance with the invention is truly an all-purpose unit that offers much greater versatility and flexibility in building construction than conventional units of the similar type made from a single mold form. The half-room configuration of the preferred embodiment described above permits the same basic unit to serve a multiplicity of functions, merely by rotating to different orientations about X, Y and Z axes and varying the placement of reinforcing bar latticework during the molding process, as needed, to provide the required strength of the composite reinforced structure. The single unit, thus described, provides almost all the different elements required for constructing a multiple housing structure, such as a hotel/-motel or condominium structure.

A one building unit type/one mold form building offers enormous advantages, including simplicity of construction, lower capital cost, higher degree of repeatability, increased ability to use unskilled labor, and increased safety due to reduced height and weight. The building units can be prepared on-site or in close proximity under all weather conditions, with only temporary shelter needed during the molding process. The single element versatility reduces greatly the number of molds needed, and the mold configuration provides ready reusability. The wheeled nature of the reusable molds permits the unit to be poured under temporary shelter then wheeled to the nearby assembly point, and erected merely by lifting the cured unit off the molding apparatus and into place. The apparatus is then cleared to be wheeled back to the shelter for use in manufacturing another identical unit.

It will be appreciated by those skilled in the art to which the invention relates that the foregoing detailed description is intended to be merely exemplary and not exclusive, and that various substitutions and modifications may be made to the described embodiments without departing from the spirit and scope of the invention as defined by the claims below.

What is claimed is:

1. A freestanding unitary precast concrete, one-half room building unit having an inverted U-shaped cross-sectional configuration and comprising:

a generally horizontally extending web having upper and lower surfaces and opposite longitudinal edges; and a pair of spaced, generally vertically extending flanges having bases; said flanges being integral with and depending from said lower surface of said web respectively adjacent said longitudinal edges;

said base of one of said flanges being formed with a tongue and said base of the other of said flanges being formed with a groove, and said tongue of said one flange being relatively dimensioned and configured to complement and fit into said groove of said other flange of an identical other unit brought in flange-to-flange inverted position relative to said unit;

said web being dimensioned, configured and adapted to serve as the ceiling or floor of a room of a building and said flanges being dimensioned, configured and adapted to serve as upper or lower halves of the room; and said web being formed adjacent said longitudinal edges with alternating tabs and voids, the positions of said tabs adjacent one longitudinal edge corresponding to the positions of said voids adjacent the other longitudinal edge, and said tabs of said one edge being relatively dimensioned and configured to complement and fit into said voids of said other edge of an identical other unit brought in diagonally adjacent inverted position relative to said unit.

2. A precast building unit as in claim 1, further comprising a latticework of intermeshed reinforcing bars integrated within the structure of said unit.

3. A precast building unit as in claim 1, wherein said flanges are formed with hollow cores running vertically therethrough, said cores being dimensioned, configured and adapted for receiving reinforcing bars therethrough to extend between said unit and like cores of adjacent identical building units utilized in building construction and for receiving a poured binding substance therein to form reinforcing columns rigidly joining the units.

4. A room structure comprising a first precast building unit as in claim 1 and a second, identical unit inverted and positioned in flange-to-flange position relative to said first unit with said bases joined so that said tongue of said first unit is fitted into said groove of said second unit, and said tongue of said second unit is fitted into said groove of said first unit, said first unit serving as the ceiling and top halves of opposite walls of said room structure and said second unit serving as the floor and lower halves of the opposite walls of said room structure.

5. A room structure as in claim 4, wherein said flanges of said units are uniformly outwardly tapered from said bases to said lower surfaces, and the walls have indentations at the location of said joined bases; and said structure further comprises at least one linear diffusing unit of arcuate shape mounted on said units and having a concavity facing one of said indentations.

6. A precast building unit, as in claim 1, wherein said flanges have a lateral horizontal dimension adjacent said longitudinal edges, and said voids have a corresponding lateral horizontal dimension equal to generally one-half of said lateral horizontal dimension of said flanges.

7. A precast building unit as in claim 6, wherein said web has a vertical dimension adjacent said flanges, and said voids have a corresponding vertical dimension equal generally to one-half of said vertical dimension of said web.

8. A structure comprising a first precast building unit as in claim 1 and a second, identical unit inverted positioned in diagonally adjacent, web-to-web position relative to said first unit, with said units joined so that said tabs of said one longitudinal edge of said first unit are fitted into said voids of said other longitudinal edge of said second unit, and said tabs of said other longitudinal edge of said second unit are fitted into said voids of said one longitudinal edge of said first unit, said first unit serving as the ceiling and top halves of opposite walls of a room on a lower level of said structure and said second unit serving as the floor and lower halves of opposite walls of a room on an upper level of said structure.

* * * * *